United States Patent [19]

Cariello et al.

[11] Patent Number: 4,460,460

[45] Date of Patent: Jul. 17, 1984

[54] BENEFICIATION OF ORES

[75] Inventors: Frank Cariello, Somerville; Ross A. Kremer, Bell Meade, both of N.J.

[73] Assignee: Mobil Oil Corporation, New York, N.Y.

[21] Appl. No.: 367,832

[22] Filed: Apr. 13, 1982

[51] Int. Cl.[3] ..... B03D 1/14

[52] U.S. Cl. ..... 209/166; 209/167

[58] Field of Search ..... 209/5, 10, 166, 167; 210/772

[56] References Cited

U.S. PATENT DOCUMENTS

| | | | |
|---|---|---|---|
| 3,388,793 | 6/1968 | Dibble | 209/166 |
| 3,768,646 | 10/1973 | Grannen | 209/166 |
| 3,817,972 | 6/1974 | Grannen | 209/166 |
| 4,172,029 | 10/1979 | Hefner | 209/166 |
| 4,289,612 | 9/1981 | Schrieber | 209/166 |

*Primary Examiner*—Bernard Nozick

*Attorney, Agent, or Firm*—Alexander J. McKillop; Michael G. Gilman; Claude E. Setliff

[57] ABSTRACT

Beneficiation of ores, especially phosphate ores, is improved by using deionized or softened water in the conditioning step.

3 Claims, No Drawings

BENEFICIATION OF ORES

BACKGROUND OF THE INVENTION

1. Field of the Invention:

The invention relates to the beneficiation of ores. More particularly it relates to the beneficiation of phosphate ores, and still more particularly to an improved benefication process which employs softened or deionized water in the conditioning step prior to rougher flotation.

2. Discussion of the Prior Art:

Phosphate ore is found in various places in nature, and it contains a valuable raw material for producing many products, principally fertilizer. The most useful constituent of the ore is calcium fluorophosphate; those of no value include calcium carbonate, carbonaceous materials, heavy minerals and siliceous materials such as silica. Removal of these valueless materials is necessary and has been the subject of extended research.

As taught in U.S. Pat. No. 3,817,972, partial concentration is first employed to remove phosphatic clays and this is followed by two separate beneficiation steps. The first one is the fatty acid flotation of phosphate values using an acid and a strong base in combination with a petroleum fraction such as kerosene. The fraction obtained, or rougher concentrate, still contains considerable siliceous material which is treated in a second flotation using long chain fatty acid amines or salts thereof. No art is known that teaches or suggests improving flotation in areas where very hard water is encountered by using deionized or softened water in the conditioning step.

SUMMARY OF THE INVENTION

In accordance with this invention, there is provided an improved process for beneficiating ores, particularly phosphate ores, in which there are at least two separate flotation steps, the first being a flotation step employing the usual reagents, such as a fatty acid and a petroleum fraction and the second flotation step being one in which a fatty acid amine or salt such as is taught in U.S. Pat. No. 3,817,972 (incorporated herein by reference) is used, the improvement comprising employing deionized or softened water in the conditioning step prior to the first flotation, thereby reducing or substantially eliminating the increased usage of reagents caused by the presence of hard water.

DESCRIPTION OF SPECIFIC EMBODIMENTS

In Florida and in other mining locations, phosphate rock does, or may occur in sedimentary deposits below an overburden, the top layer of which is mostly sand. In the former, the zone between the bottom of the overburden and the phosphate deposit is referred to as the "leach zone". This is a zone of aluminum phosphate minerals (mainly wavellite and cradallite) which average the equivalent of 20 to 30% aluminum phosphate, with 5 to 15% clay and the rest sand. This zone is currently discarded. The matrix is about 15 feet thick and is currently the actively-mined zone. Below the matrix is a thin layer of clay (0 to 3 feet) on top of an approximately 200-foot layer of limestone. The limestone layer contains considerable phosphate deposit and it is considered to be the source rock of the phosphate deposit. The phosphate minerals were deposited originally from warm currents of ocean water. Subsequently, the deposits were reworked by submarine currents; even later they were weathered by streams and rainfall.

The matrix, which will vary greatly, is an unconsolidated mixture with a composition approximately one-third each of fluorapatite (the main phosphate component), quartz sand, and a mixture of clays. The clays present are primarily montmorillonite and attapulgite. Fluorapatite has the composition $Ca_5(PO_4)_3F$. The mineral present in the ore also contains carbonate and hydroxyl as part of the structure.

In processing the ore, about 70% of the phosphate is recovered from the matrix and about 20% is lost in the slimes as particles smaller than 150 mesh (105 micrometers). Another 10% is lost with the sand tailings from the flotation plant. The phosphate recovered contains, among other things, large pebbles and concentrate from the flotation. The amounts of these will vary greatly, depending upon the source of the deposit.

Without detailing the flotation operation, the general problems of separation are associated with the wide particle distribution of sand and phosphate in the flotation feed and the presence of any unremoved clays. This distribution occurs even though the feed is segregated into two sizes. While the fatty acid float is selective, there is a tendency for the larger phosphate particles to settle too quickly and thus are lost as tailings. The fine sand also tends to float with the phosphate rock.

Normally, in commercial practice in the first or fatty acid flotation step, from about 0.5 to about 1.5 pound of acid per ton of ore is used, along with about 3 times as much petroleum fraction, i.e., from about 1.5 pounds to about 4.5 pounds per ton thereof. With optimum use of these reagents, one can obtain a recovery of up to about 80–90% by weight of the BPL in the flotation feed. This represents about the maximum one can attain with this reagent system in this step. When the amount of reagents used in the fatty acid flotation step are added to those used in the amine, or second flotation, the total quantity of reagent is quite substantial and accounts for a significant proportion of the total cost of processing phosphate ore.

If one adds to the losses discussed above those encountered from use of hard water, the added costs can be prohibitive. The art knows about losses of phosphate values from use of hard water, and attempts have been made to solve the problem. The known solutions, however, involve increasing the amount of reagents or making available to the flotation plant a full supply of water not having a deleterious hardness factor. So far as is known, no one has ever taught or suggested that this problem could be solved by employing softened or deionized water in just the conditioning step, a step in which a minor portion of the total flotation water required is used.

In general terms, the process of this invention involves the following steps. After the phosphate rock is mined, it is conveyed to the beneficiating plant by any convenient means. Once at the processing plant, the ore is mixed with water and is classified by rapidly putting it through a series of screens, washers, cyclones and sizers. The resulting flotation feed may be stored prior to beneficiation, where it normally reaches a solids content of 85–90% or it may be dried to this solids content by mechanical means. The flotation feed is then diluted with deionized or softened water to a solids content of from 70–75 weight percent of solids and is pumped into a feed conditioner where a fatty acid, or other organic compound or compounds, a petroleum fraction and caustic are blended in.

The fatty acid may be any acid normally used in phosphate ore benefication. A useful acid is an oleic acid ($C_{18}$) or a mixture of acids of the $C_{18}$ molecular weight range, such as that present in tall oil. One acid that is commonly used in the industry has the approximate compositions:

| Acid | Percent |
|---|---|
| Palmitic | 6 |
| Palmitoleic | 2 |
| Stearic | 1 |
| Oleic | 31 |
| Linoleic | 42 |
| Docosenoic | 3 |
| Linolenic | 5 |
| Rosin | 7 |
| Unsaponifiables | 3 |

The first flotation produces a so-called rougher concentrate, which is passed through an acid deoiler section where the concentrate is treated with sulfuric acid to remove fatty acid. It is then washed, treated with an amine and a petroleum fraction and refloated to remove the silica that floated with the apatite in the first stage.

The petroleum fraction useful in phosphate flotation processes can be any of a number of products normally used in the phosphate industry. These include kerosene, or range oil, and the distillate fuel oils, including Nos. 1 through 6. Further, the term "petroleum fraction" includes those whose properties are described on pages 11–41 through 11–56 of the Petroleum Processing Handbook, McGraw-Hill Book Company (1967).

The useful amines include those described in U.S. Pat. No. 3,388,792. They also include fatty acid amines such as those described in U.S. Pat. Nos. 3,817,972 and 3,768,646.

Having broadly described the invention, following are illustrations thereof. It will be understood that they are illustrative only and that they are not intended to limit the invention.

EXAMPLE 1

A sample of classified phosphate ore (35×150 mesh) containing 85–90% solids was diluted to 70% solids with hard water containing 335 ppm total hardness. To this was added 0.17 lb. per ton of feed of sodium hydroxide and the resulting slurry was agitated for 15 seconds. Then 0.5 lb. per ton of ore of a tall oil fatty acid of composition such as described above, and 1.5 lbs. per ton of No. 5 fuel oil were added and the slurry was agitated for an additional 90 seconds. The conditioned feed was charged to a Denver Lab flotation cell and diluted from 70% solids to 20% solids with the same hard water as above, and floated. No phosphate was recovered.

EXAMPLE 2

Example 1 was repeated except that deionized water was used for conditioning and flotation. 94% of the available phosphate values was recovered.

EXAMPLE 3

Example 1 was repeated, except that deionized water was used for conditioning and hard water (335 ppm total hardness) was used for flotation. Again, 94% of the available phosphate values was recovered.

As is apparent from the data obtained, there is no difference in yield of phosphate between the two runs of Examples 2 and 3. It was entirely unexpected that the use of deionized or softened water in the feed conditioning step only would give this result.

We claim:

1. An improved process for beneficiating phosphate ores using hard water in which there are at least two flotation steps, the first being a rougher float utilizing reagents consisting essentially of a fatty acid and a petroleum fraction and the second step being one in which reagents comprising fatty acid amine are used, the improvement comprising using deionized or softened water in the conditioning step prior to the rougher flotation, wherein hard water is used in said rougher flotation.

2. The process of claim 1 wherein the feed is first classified and then diluted with the deionized or softened water to a solids content of 70–75%.

3. The process of claims 1, or 2 wherein the water is deionized.

* * * * *